US010786018B2

(12) United States Patent
Fletcher

(10) Patent No.: US 10,786,018 B2
(45) Date of Patent: Sep. 29, 2020

(54) NURSING BRA

(71) Applicant: Jennifer Fletcher, Acworth, GA (US)

(72) Inventor: Jennifer Fletcher, Acworth, GA (US)

( * ) Notice: Subject to any disclaimer, the term of this patent is extended or adjusted under 35 U.S.C. 154(b) by 117 days.

(21) Appl. No.: 16/023,405

(22) Filed: Jun. 29, 2018

(65) Prior Publication Data

US 2019/0000152 A1 Jan. 3, 2019

Related U.S. Application Data

(60) Provisional application No. 62/527,866, filed on Jun. 30, 2017.

(51) Int. Cl.
*A41C 3/04* (2006.01)
*A41C 3/12* (2006.01)

(52) U.S. Cl.
CPC . *A41C 3/04* (2013.01); *A41C 3/12* (2013.01)

(58) Field of Classification Search
CPC ..... A41C 3/04; A41C 3/12; A41F 15/002
USPC ..... 450/36
See application file for complete search history.

(56) References Cited

U.S. PATENT DOCUMENTS 8,061,068 B1 * 11/2011 Donovan ..... A41C 3/04 40/586
8,523,629 B2 * 9/2013 Pundyk ..... A41C 3/0021 450/30
9,937,096 B2 * 4/2018 Aldridge ..... A61H 1/0237

* cited by examiner

*Primary Examiner* — Timothy K Trieu
(74) *Attorney, Agent, or Firm* — Lee Sullivan Shea & Smith LLP

(57) ABSTRACT

A nursing bra assembly is adapted to be worn by a mother when nursing a child, and the nursing bra assembly includes a nursing bra portion having a bra body that includes a left cup portion and a right cup portion. The nursing bra portion includes a left strap extend from a first portion of the bra body to a second portion of the bra body and a right strap extending from a third portion of the bra body to a fourth portion of the bra body. The nursing bra assembly also includes a first attachment member having a securement portion adapted to couple the first attachment member to a portion of the nursing bra portion. The first attachment member also includes an extension portion coupled to the securement portion, the extension portion adapted to be grasped by the child when being nursed by the mother.

20 Claims, 11 Drawing Sheets

NURSING BRA

CROSS-REFERENCE TO RELATED APPLICATIONS

This application claims priority to U.S. Provisional Application No. 62/527,866 filed on Jun. 30, 2017, which is herein incorporated by reference in its entirety for all purposes.

FIELD OF THE INVENTION

This application is generally directed to bras and, more specifically, to nursing bras and attachments for nursing bras.

BACKGROUND OF THE INVENTION

Typical nursing bras allow a mother to breast feed a child by providing a detachable or partially-detachable cup. The cup, or a portion of the cup, can be detached or repositioned relative to the body of the nursing bra to expose a nipple of the mother, thereby allowing the child to latch onto the nipple and begin the feeding process. The feeding process may last for several minutes to over half of an hour. During this significant period of time, the child often becomes distracted, which results in the child moving his or her head and, as a result, de-latching from the mother. Thus, the feeding process is interrupted and the latching process must be restarted. Often, this interruption in the feeding process frustrates the child, which results in crying, and this crying could make re-latching more difficult.

Accordingly, there is a need for providing visual and/or tactile stimulation within the field of vision and reach of the child to attract and maintain the attention and interest of the child during the feeding process to keep the child latched to the mother.

SUMMARY OF THE INVENTION

A nursing bra assembly is adapted to be worn by a mother when nursing a child, and the nursing bra assembly includes a nursing bra portion. The nursing bra portion includes a bra body adapted to cover at least a portion of a chest of the mother, the bra body having a left cup portion and a right cup portion. The nursing bra portion includes a left strap that extends from a first portion of the bra body to a second portion of the bra body, the first portion being adjacent to a portion of the left cup portion. The nursing bra portion also includes a right strap that extends from a third portion of the bra body to a fourth portion of the bra body, the third portion being adjacent to a portion of the right cup portion. The nursing bra assembly further includes a first attachment member coupled to a portion of the nursing bra portion, the first attachment member having a securement portion adapted to couple the first attachment member to the portion of the nursing bra portion. The first attachment member also includes an extension portion coupled to the securement portion, the extension portion adapted to be grasped by the child when being nursed by the mother.

DETAILED DESCRIPTION OF THE INVENTION

Figure 1:
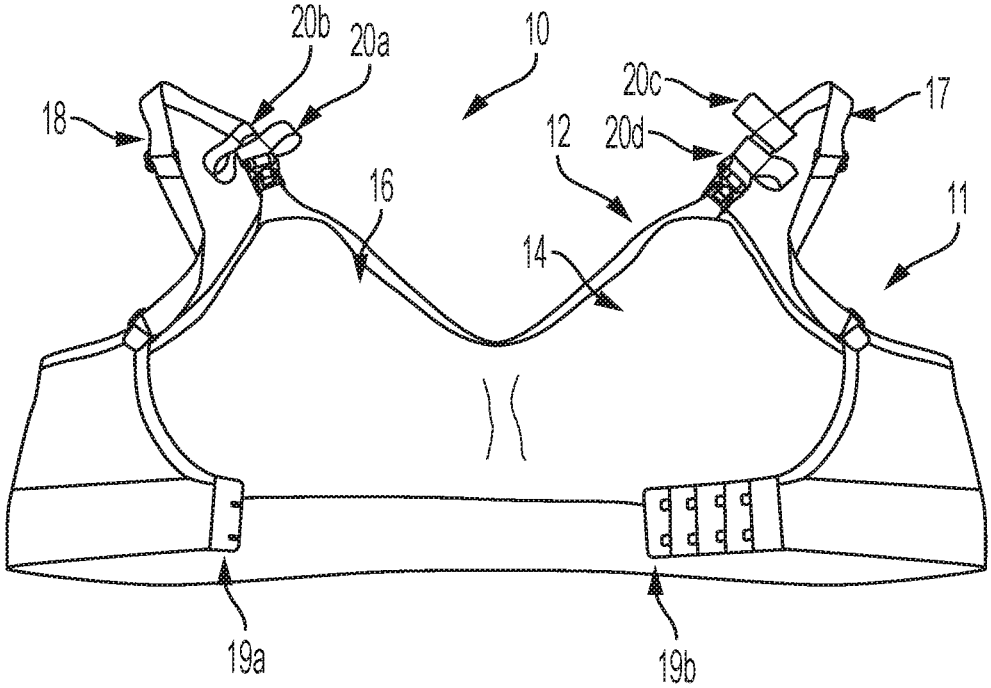
FIG. 1 is a front view of an embodiment of a nursing bra assembly.
Figure 5:
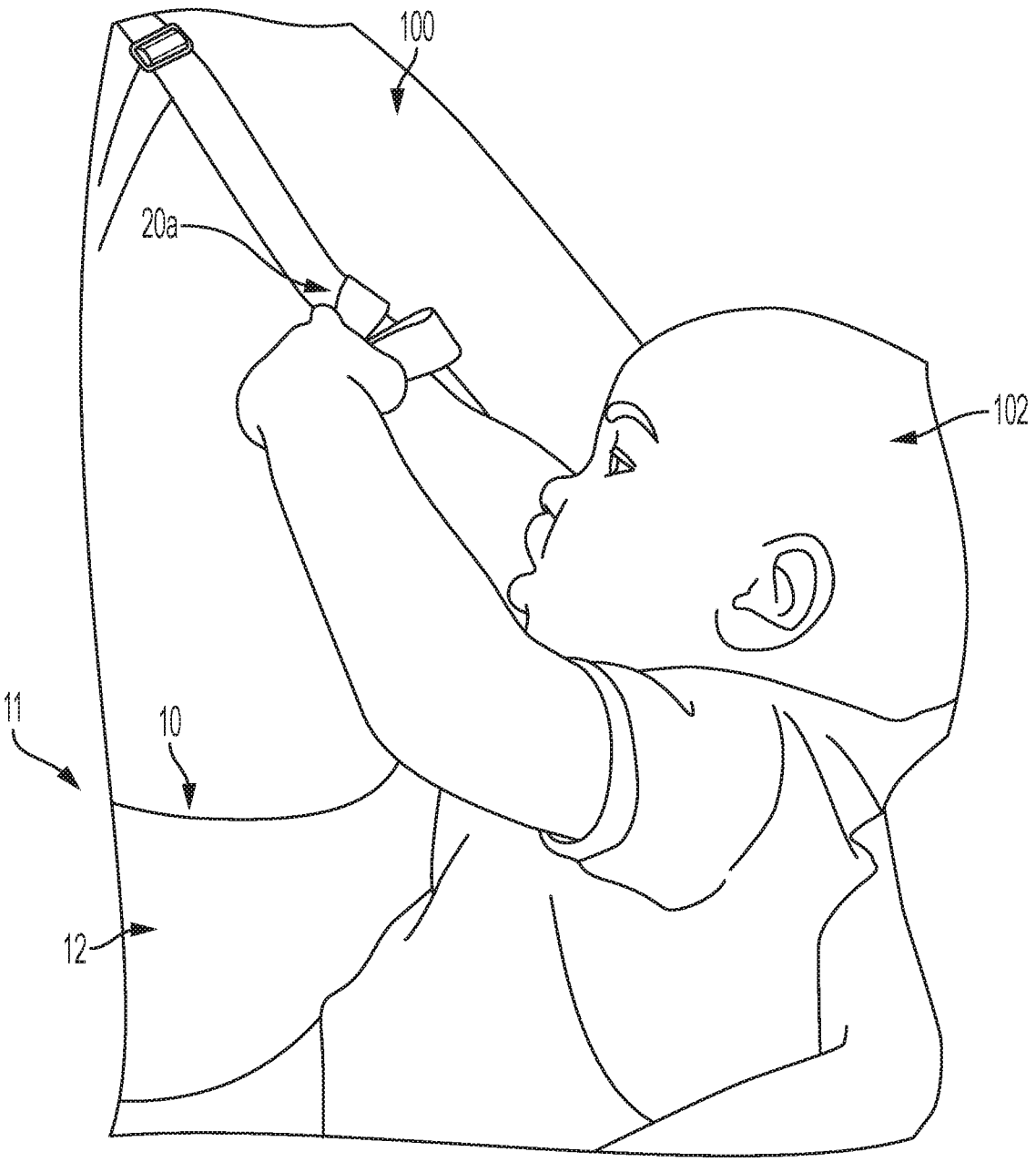
FIG. 5 is a view of a mother nursing a child using the embodiment of the nursing bra assembly illustrated in FIG. 1.

As illustrated in FIG. 5, a nursing bra assembly 10 adapted to be worn by a mother 100 when nursing a child 102 includes a nursing bra portion 11, the nursing bra portion 11 having a bra body 12 adapted to cover at least a portion of the chest of the mother 100. In some embodiments, the bra body 12 surrounds the circumference of the abdomen of the mother 100 in a known manner. Referring to FIG. 1, the bra body 12 of the nursing bra portion 11 may include a left cup portion 14 and a right cup portion 16. A left strap 17 may extend from a first portion (e.g., a first left side portion) of the bra body 12 to a second portion (e.g., a second left side portion) of the bra body 12, and the first portion (e.g., the first left side portion) may be at or adjacent to a portion of the left cup portion 14. A right strap 18 may extend from a third portion (e.g., a first right side portion) of the bra body 12 to a fourth portion (e.g., a second right side portion) of the bra body 12, and the third portion (e.g., the first right side portion) may be at or adjacent to a portion of the right cup portion 16. One having ordinary skill in the art would recognize that the left strap 17 and the right strap 18 cooperate in a known manner to maintain the left cup portion 14 and the right cup portion 16 in a suitable and comfortable position. The bra body 12 of the nursing bra portion 11 may be secured around the circumference of the abdomen of the mother 100 by a first clasp portion 19*a* that removably engages a second clasp portion 19*b* in a known manner.

Figure 2:
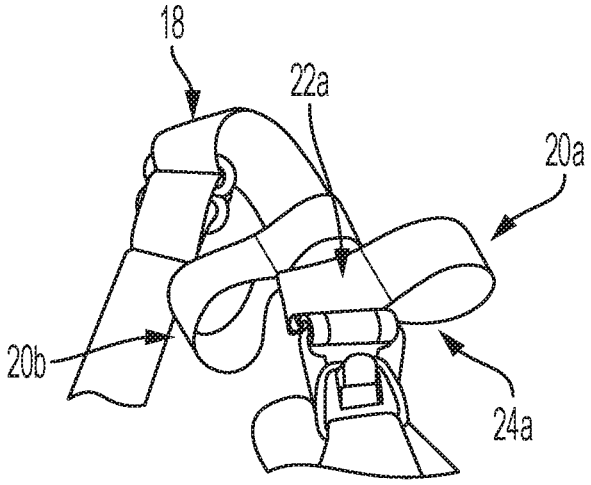
FIG. 2 is a detailed view of an embodiment of an attachment member of the embodiment of the nursing bra assembly illustrated in FIG. 1.
Figure 3:
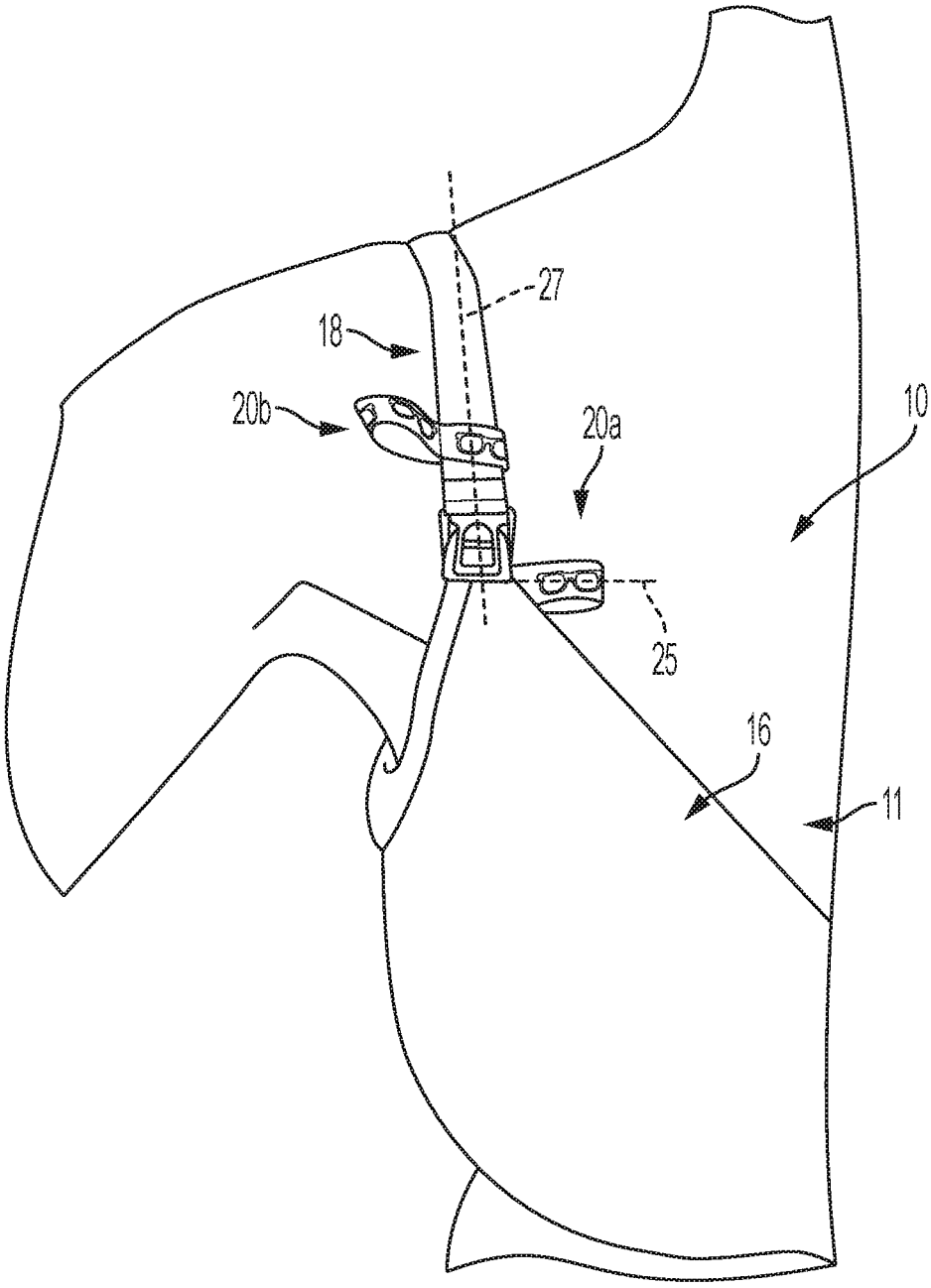
FIG. 3 is a front view of a further embodiment of a nursing bra assembly.
Figure 4:
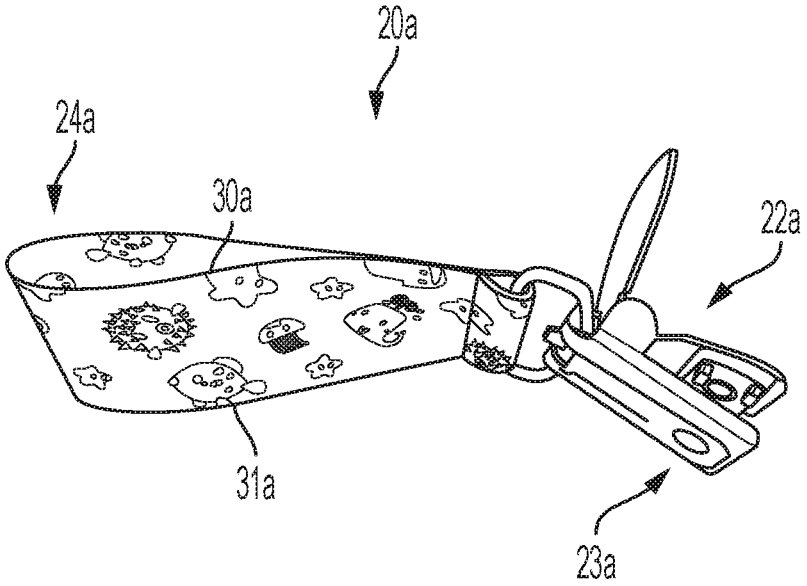
FIG. 4 is a detailed view of an embodiment of an attachment member.

As illustrated in FIGS. 1, 2, 3, and 5, the nursing bra assembly 10 may also include a first attachment member 20*a* secured to a portion of the nursing bra portion 11 (e.g., one of the left strap 17, the right strap 18, the left cup portion 14, the right cup portion 16, or any portion of the bra body 12). As illustrated in FIGS. 2 and 4, the first attachment member 20*a* may have a securement portion 22*a* adapted to couple the first attachment member 20*a* to a portion of the nursing bra portion 11. The first attachment member 20*a* may also include an extension portion 24*a* coupled to the securement portion 22*a*. As illustrated in FIG. 5, the extension portion 24*a* is adapted to be visible to and grasped by the child 102 when being nursed by the mother 100. More specifically, the extension portion 24*a* of the first attachment member 20*a* may provide tactile or visual stimulation for the child 102 when the child is nursing, thereby focusing the attention of the child 102 on the extension portion 24*a*. With the child's 102 attention fixated on the extension portion 24*a*, the child 102 maintains a suitable latching on the breast of the mother and the feeding process is thereby optimized.

Turning to the first attachment member 20*a* in more detail, the securement portion 22*a* may be coupled to any suitable portion or portions of the nursing bra portion 11, such as one of the left strap 17, the right strap 18, the left cup portion 14, the right cup portion 16, or any portion of the bra body 12 in any suitable manner. In some embodiments, such as those illustrated in FIGS. 1 to 3, the securement portion 22*a* may be permanently or non-removably coupled to one or more portions of the nursing bra portion 11. For example, the securement portion 22*a* may be made of fabric (or other material, such a plastic) that is sewn, glued, fused, adhered, fastened, tied or otherwise coupled to one or more portions of the nursing bra portion 11.

In other embodiments, the securement portion 22*a* may be removably coupled to one or more portions of the nursing bra portion 11. For example, the securement portion 22*a* may secured to one or more portions of the nursing bra portion 11 using one or more of a hook and loop fastener, a snap, a clip, a knot (e.g., a slipknot) or any other suitable removable securement device(s). For example, FIG. 4 illustrates an embodiment of a first attachment member 20*a* with a securement portion 22*a* that includes a clip portion 23*a* that is adapted to be removably secured to one or more portions of the nursing bra portion 11. The mother may squeeze opposing arm portions of the clip portion 23*a* to open the clip portion 23*a* and release the opposing arm portions of the clip portion 23*a* when in a suitable position to secure the first attachment member 20*a* to the nursing bra portion 11.

The extension portion 24*a* of the first attachment member 20*a* may be coupled to the securement portion 22*a* in any suitable manner. In some embodiments, the extension portion 24*a* may be permanently or non-removably fixed to the securement portion 22*a*. For example, as illustrated in FIG. 4, the extension portion 24*a* may be made of fabric, and an end portion of the fabric may be sewn to form a loop that receives an end portion of the clip portion 23*a*. In other embodiments, the extension portion 24*a* may be integrally formed with the securement portion 22*a*, and the extension portion 24*a* may be made from or comprise the same piece of material (e.g., fabric or plastic) as the securement portion 22*a*. In still other embodiments, the extension portion 24*a* may be removably coupled to the securement portion 22*a*. For example, the extension portion 24*a* may be snapped or clipped to the securement portion 22*a* or a portion of the securement portion 22*a*. In other embodiments, the extension portion 24*a* may be coupled to the securement portion 22*a* using a hook-and-loop fastening device. In some embodiments, different extension portions 24*a* (e.g., a first extension portion 24*a* and a second extension portion 24*b*) may be interchanged on the same securement portion 22*a*, and the first extension portion 24*a* may be different (e.g., have a different shape and/or pattern and/or attachment) than the second extension portion 24*b*.

In some embodiments, the extension portion 24*a* may be elongated and may extend from the securement portion 22*a*. In such embodiments, the extension portion 24*a* form a loop that extends from the securement portion 22*a*, as illustrated in FIGS. 2 and 4. In other embodiments, the extension portion 24*a* may include two or more elongated portions (such as ribbons). In other embodiments, the extension portion 24*a* may include one or more plush components, such as tassels. In some embodiments, the extension portion 24*a* (and, in some embodiments, the securement portion 22*a*) may extend (or generally extend) along an axis 25 that may be normal to an axis 27 extending along the left strap 17 and/or the right strap 18, as illustrated in FIG. 3. In other embodiments (not shown), the extension portion 24*a* (and, in some embodiments, the securement portion 22*a*) may extend (or generally extend) along an axis 25 that may not be normal to the axis 27 extending along the left strap 17 and/or the right strap 18, and in some embodiments (not shown), the extension portion 24*a* (and/or the securement portion 22*a*) may extend (or generally extend) along an axis 25 that may be aligned with or parallel to the axis 27 extending along the left strap 17 and/or the right strap 18.

The extension portion 24*a* may have any suitable dimensions and/or shape to be visible to and grasped by the child when being nursed by the mother. In some embodiments, the length of the extension portion 24*a* (i.e., the dimension along the axis 25) may be 1.5 to 5 times the width of the extension portion 24*a* (i.e., the dimension normal to the axis 25). In some embodiments, the extension portion 24*a* may include two opposing lateral edges 30*a* and 31*a*, as illustrated in FIG. 4. The lateral edges 30*a*, 31*a* may extend along axis 25 and/or may be linear or substantially linear. In other embodiments, the lateral edges 30*a*, 31*a* may be at least partially contoured or non-linear.

In some embodiments, one or more attachments (not shown) may be coupled to or fixed to the extension portion 24*a* (or the securement portion 22*a*), and the one or more attachments may be any suitable attachment that can be grasped by a child as the child nurses to maintain the child's attention. For example, the one or more attachments may be a teething ring, one or more ribbons, a plastic attachment, a plush attachment, or the like.

Figure 9:
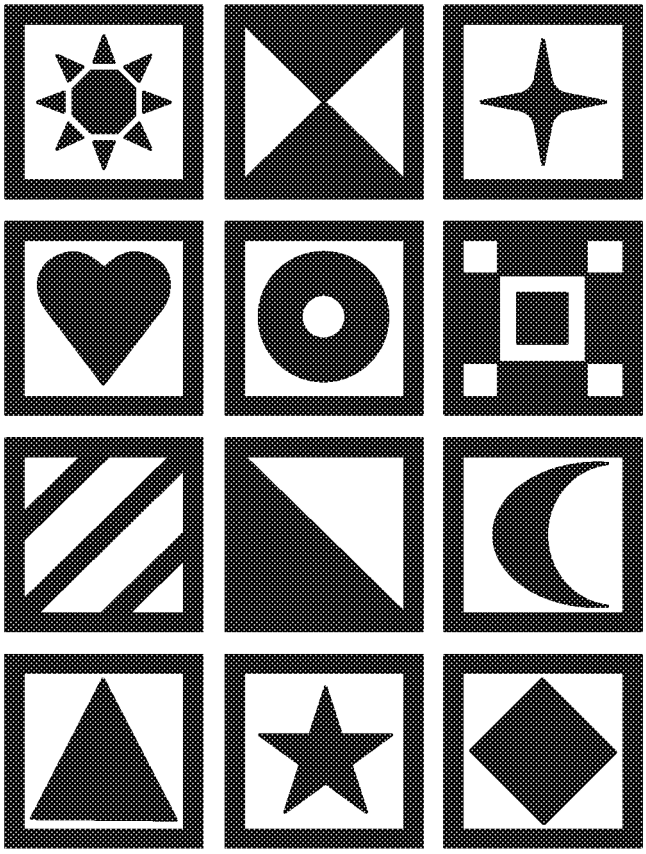
FIG. 9 is an embodiment of a pattern of an embodiment of a sensory insert.

The extension portion 24*a* and the securement portion 22*a* may be made from any suitable material. For example, the extension portion 24*a* and/or the securement portion 22*a* may be made from fabric or plastic, and the fabric or plastic (or any other material or combination of materials) may have any color (or combination of colors) or texture (or combination of textures). In some embodiments, the material may have one or more first portions with a first texture (e.g., a plush texture, raised texture, rough texture) and one or more second portions that are different than at least one of the first portions. In some embodiments, the material may have one or more patterns, graphics, and/or images, such as the fabric illustrated in FIGS. 3 and 4. The pattern(s), graphic(s), and/or image(s) may include any pattern, graphic, and/or image (or combination of patterns, graphics, and/or images) that attracts or is capable of attracting the attention of a child during nursing. For example, the pattern, graphic, and/or image may include a high-contrast pattern, graphic, and/or image. For example, the pattern, graphic, and/or image may include black and white patterns, graphics, and/or images, such as those (or similar to those) illustrated in FIG. 9. The pattern(s), graphic(s), and/or image(s) may cover the entire extension portion 24*a* or one or more portions of the extension portion 24*a*.

In other embodiments, the extension portion 24*a* and/or the securement portion 22*a* may be made from a rigid or semi-rigid plastic material. The extension portion 24*a* and the securement portion 22*a* may be made from the same materials (or combination of materials) or from different materials (or combination of materials).

In some embodiments, as illustrated in FIG. 1, the nursing bra assembly 10 may include any number of attachment members 20*a* previously described. For example, the nursing bra 10 may include: a second attachment member 20*b* secured to a portion of the nursing bra portion 11; a third attachment member 20*c* secured to a portion of the nursing bra portion 11; and/or a fourth attachment member 20*a* secured to a portion of the nursing bra portion 11. In some embodiments, the first attachment member 20*a* and the second attachment member 20*b* may be secured to the right strap 18, and the third attachment member 20*c* and/or the fourth attachment member 20*d* may be secured to the left strap 17 (or vice versa). The attachment member 20*a* may be different than at least one of the second attachment member 20*b*, the third attachment member 20*c*, and the fourth attachment member 20*d*. For example, the extension portion 24*a* of the first attachment member 20*a* may include a first color, shape, and/or pattern and the extension portion 24*b* of the second attachment member 20*b* may include a second color, shape, and/or pattern. In some embodiments, the extension portion 24*c* of the third attachment member 20*c* may include a third color, shape, and/or pattern and the extension portion 24*d* of the fourth attachment member 20*d* may include a fourth color, shape, and/or pattern.

Any or all of the first attachment member 20*a*, the second attachment member 20*b*, the third attachment member 20*c*, and the fourth attachment member 20*d* (and any further attachment members) may be secured to a suitable portion of the nursing bra portion 11 at any suitable location.

In some embodiments, the first attachment member 20*a* may have a securement portion 22*a* coupling the first attachment member 20*a* to a first portion of the nursing bra portion 11, and the second attachment member 20*b* may have a securement portion 22*b* coupling the second attachment member 20*b* to a second portion of the nursing bra portion 11. The securement portion 22*a* of the first attachment member 20*a* and the securement portion 22*b* of the second attachment member 20*b* may each (e.g., both) be coupled (e.g., removably coupled) to one of the right strap 18 or the left strap 17. The securement portion 22*a* of the first attachment member 20*a* and the securement portion 22*b* of the second attachment member 20*b* may be offset along the axis 27 that extends along one of the left strap 17 or the right strap 18, as illustrated in FIG. 3. In some embodiments, the extension portion 24*a* of the first attachment member 20*a* and the extension portion 24*b* of the second attachment member 20*b* each extends along an axis 25 that is normal to the axis 27 that extends along one of the left strap 17 or the right strap 18.

In use, when the mother 100 nurses the child 102 (as illustrated in FIG. 5), the child 102 can grasp the first attachment member 20*a* (e.g., the extension portion 24*a*) and/or any other attachment members 20*b*, 20*c*, 20*d* to stimulate the child and prevent or reduce restlessness. Thus, with the child 102 occupied with grasping and holding the first attachment member 20*a*, the child 102 will continue to latch to the mother 100, thereby making the nursing process more efficient.

Figure 6:
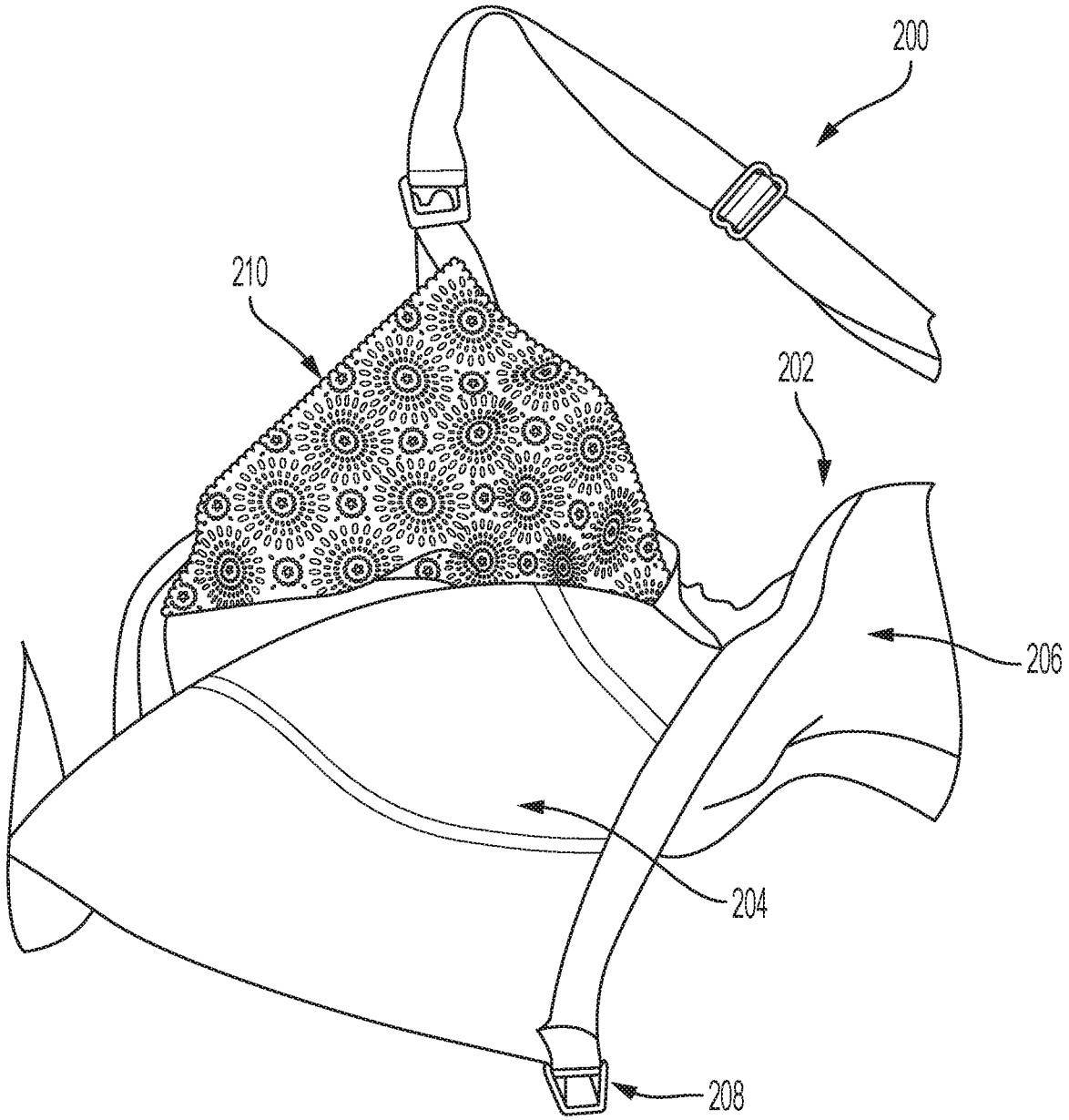
FIG. 6 is a front view of a further embodiment of a nursing bra.
Figure 7:
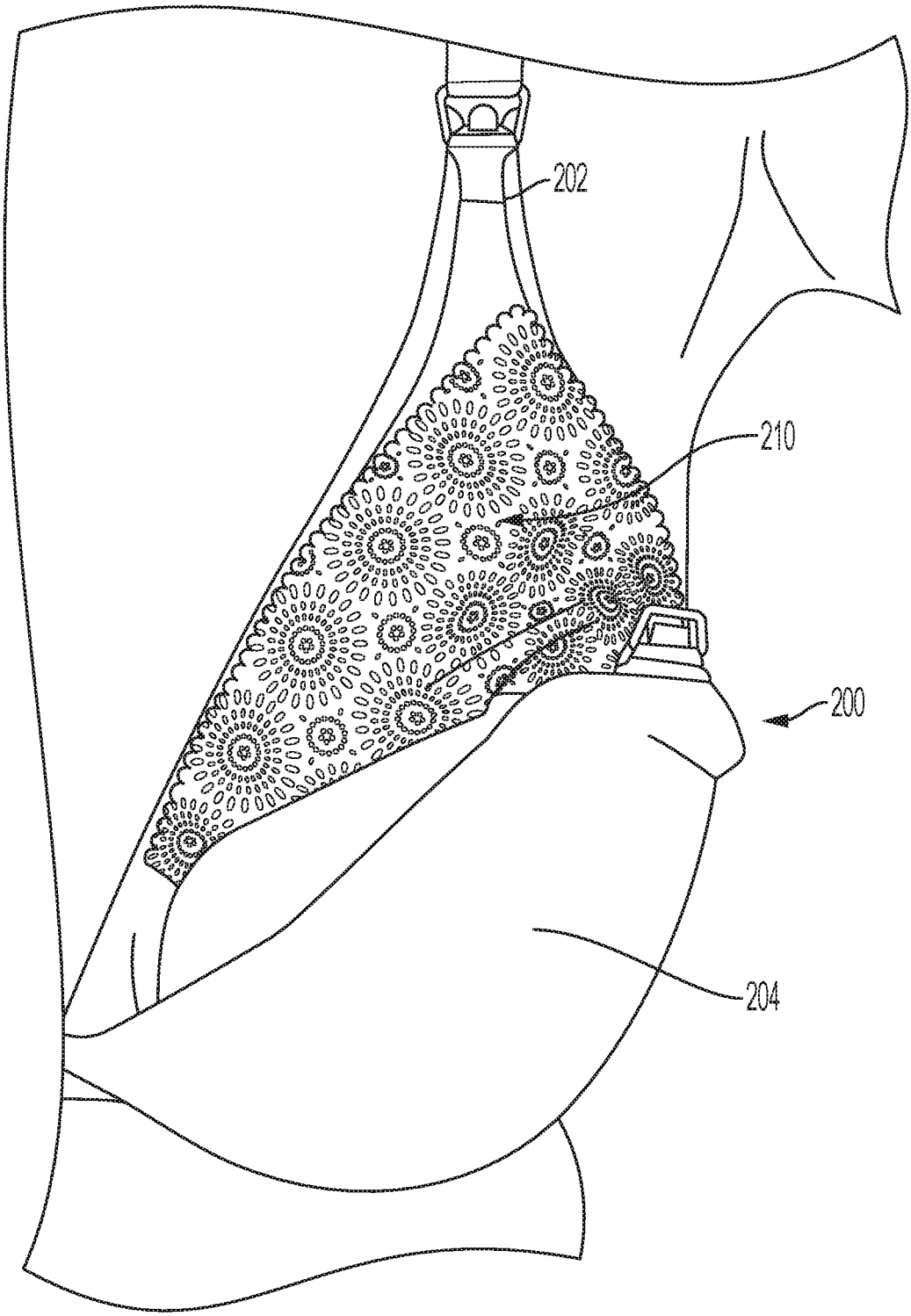
FIG. 7 is a view of the embodiment of the nursing bra illustrated in FIG. 6 with a cup portion in an unattached position to expose an embodiment of a sensory insert.

FIG. 6 illustrates another embodiment of a nursing bra 200. The nursing bra 200 may include a bra body 202, a first cup portion 204, and a second cup portion 206, as is known in the art. The first cup portion 204 may be on the left side of a mother and the second cup portion 206 may be on the right side of a mother, or vice versa. A portion of the first cup portion 204 (and/or the second cup portion 206) may be removably attached in any suitable manner (e.g., a clasp, hook and loop, snap, etc.) to a portion of the bra body 202, as is known in the art. For example, as illustrated in FIG. 6, a clasp 208 may be disposed at a top portion of the first cup portion 204 (and/or the second cup portion 206) and the clasp 208 may be removably secured to a portion of the bra body 202 such that when unclasped, the top portion of the first cup portion 204 may be folded downwards for nursing. A sensory insert 210 (or sensory portion) may be secured to a portion of the bra body 202 (and/or a portion of the first cup portion 204 and/or the second cup portion 206) such that when the first cup portion 204 (and/or the second cup portion 206) is in a detached position (illustrated in FIGS. 6 and 7) or any position suitable for nursing, the sensory insert 210 is visible (or at least partially visible) to the nursing child. In some embodiments, the sensory insert 210 may be positioned on the bra body 12 (and/or a portion of the first cup portion 204 and/or a portion of the second cup portion 206) such that the sensory insert 210 is positioned at a top portion of the mother's breast when the nursing bra 200 is worn. However, the sensory insert 210 may be positioned at or adjacent to any suitable portion or portions of the mother's breast in the detached position such that the sensory insert 210 is visible to the child when nursing. In some embodiments, the sensory insert 210 may be generally triangular or may have any other suitable shape or combination of shapes. The sensory insert 210 may be permanently secured to the bra body 202 (and/or a portion of the first cup portion 204 and/or a portion of the second cup portion 206) or may be partially or completely removable from the bra body 202 (and/or a portion of the first cup portion 204 and/or a portion of the second cup portion 206). In some embodiments, two or more sensory inserts 210 may be provided to be interchangeably attachable to the bra body 202 (and/or a portion of the first cup portion 204 and/or a portion of the second cup portion 206). Each of the two or more sensory inserts 210 may be identical or may be different (e.g., different patterns, graphics, and/or images, as will be described in more detail below).

The sensory insert 210 may have a visible portion that may be at least partially covered by a pattern, graphic, and/or image. The pattern, graphic, and/or image may be any pattern, graphic, and/or image (or combination of patterns, graphics, and/or images) that attracts or is capable of attracting the attention of a child during nursing. For example, the pattern, graphic, and/or image may include a high-contrast pattern, graphic, and/or image. For example, the pattern, graphic, and/or image may include black and white patterns, graphics, and/or images, such as those (or similar to those) illustrated in FIG. 9. The visible portion of the sensory insert 210 may cover the entire sensory insert 210 or one or more portions of the sensory insert 210.

Figure 8:
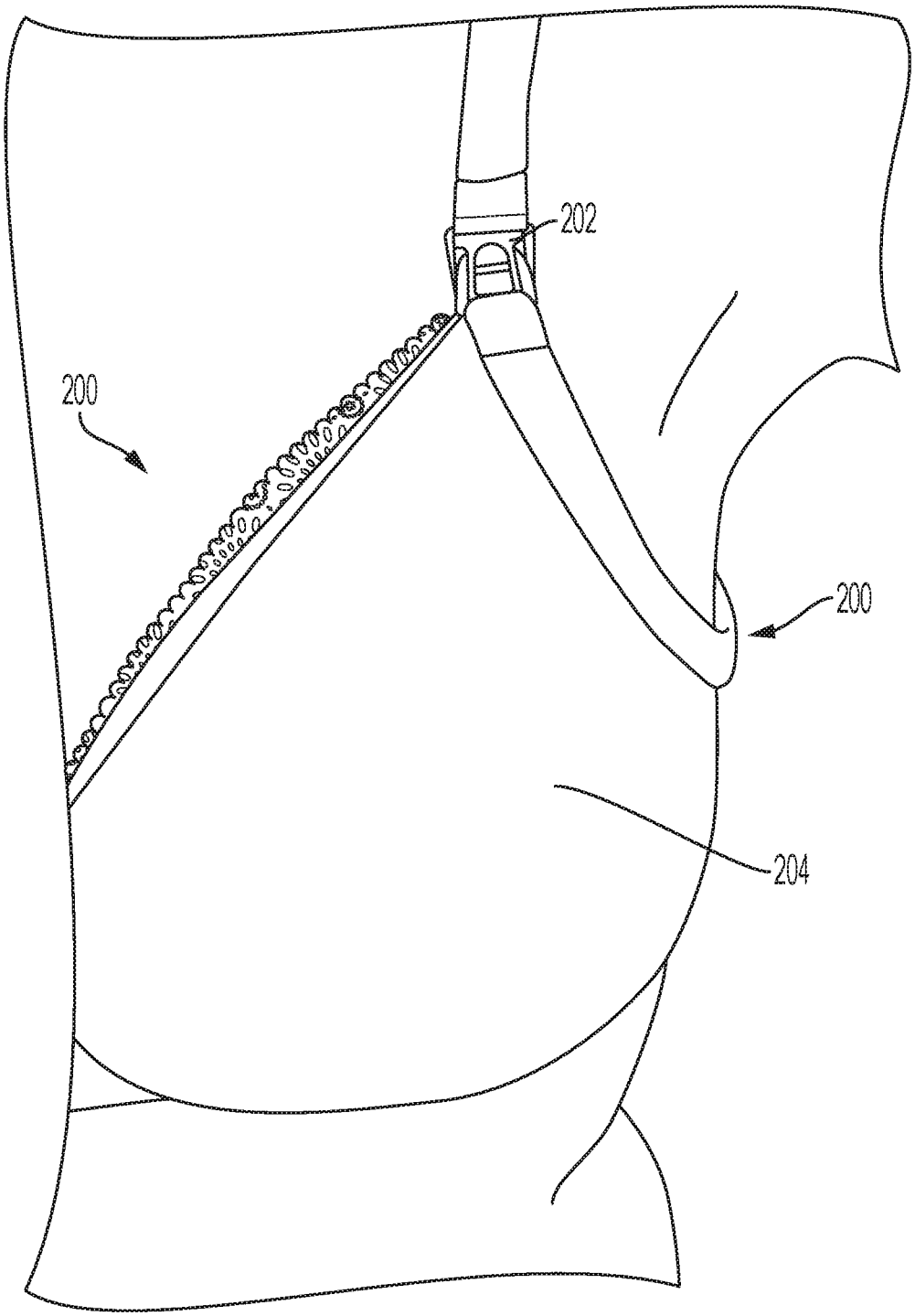
FIG. 8 is a view of the embodiment of the nursing bra illustrated in FIG. 6 with the cup portion in an attached position.

In use, a nursing mother may uncouple the clasp 208 to displace the first cup portion 204 (and/or the second cup portion 206) from a secured position (illustrated in FIG. 8) to an unsecured position (illustrated in FIG. 7) and ultimately to a nursing position. When the child nurses, the pattern, graphic, and/or image attracts and maintains the attention of the child, thereby reducing restlessness in the child and making the nursing process more efficient.

Figure 10:
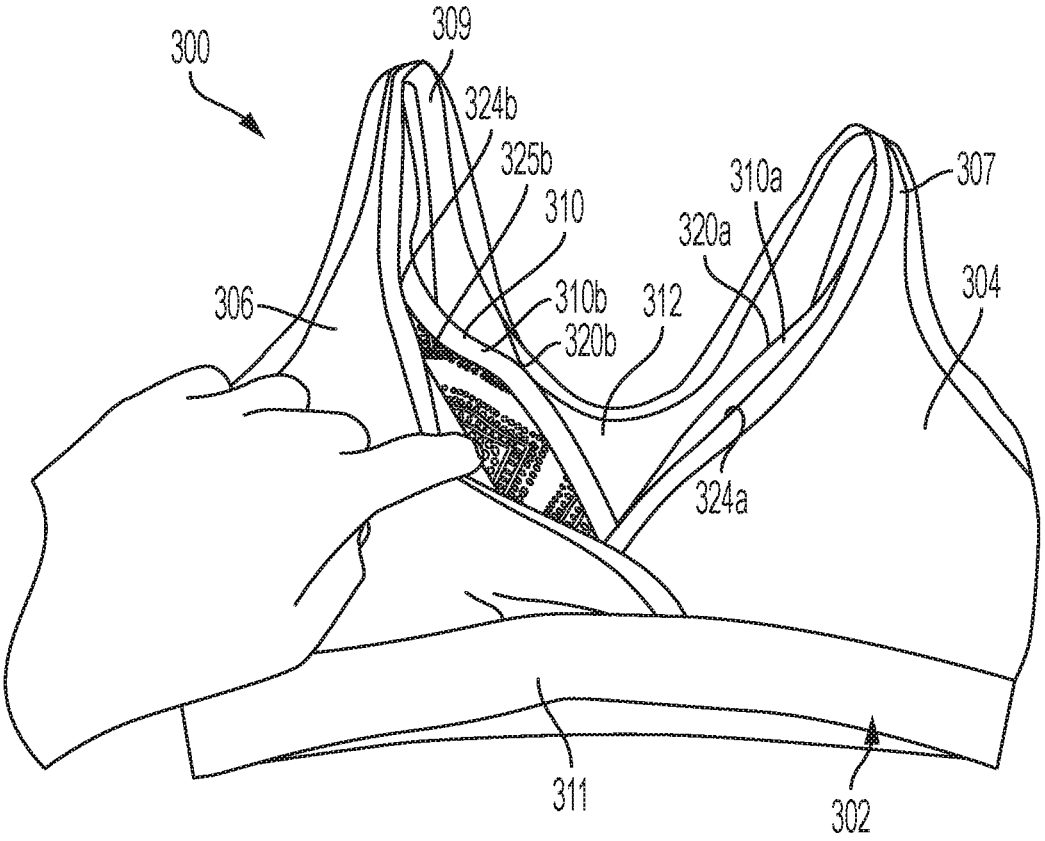
FIG. 10 is a front view of a further embodiment of a nursing bra.
Figure 11:
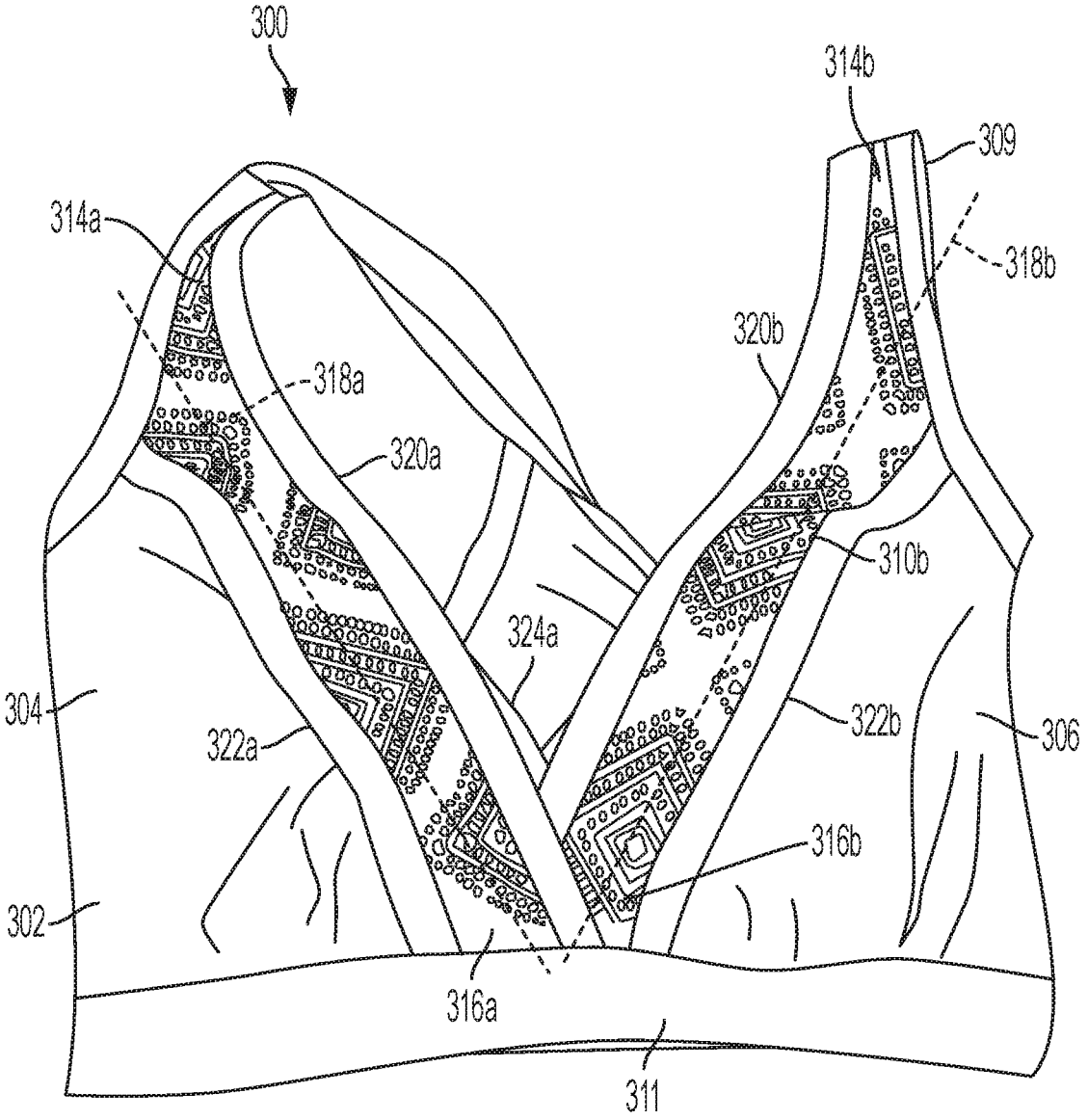
FIG. 11 is a rear view of a first cup portion and a second cup portion of the embodiment of the nursing bra illustrated in FIG. 10.
Figure 12:
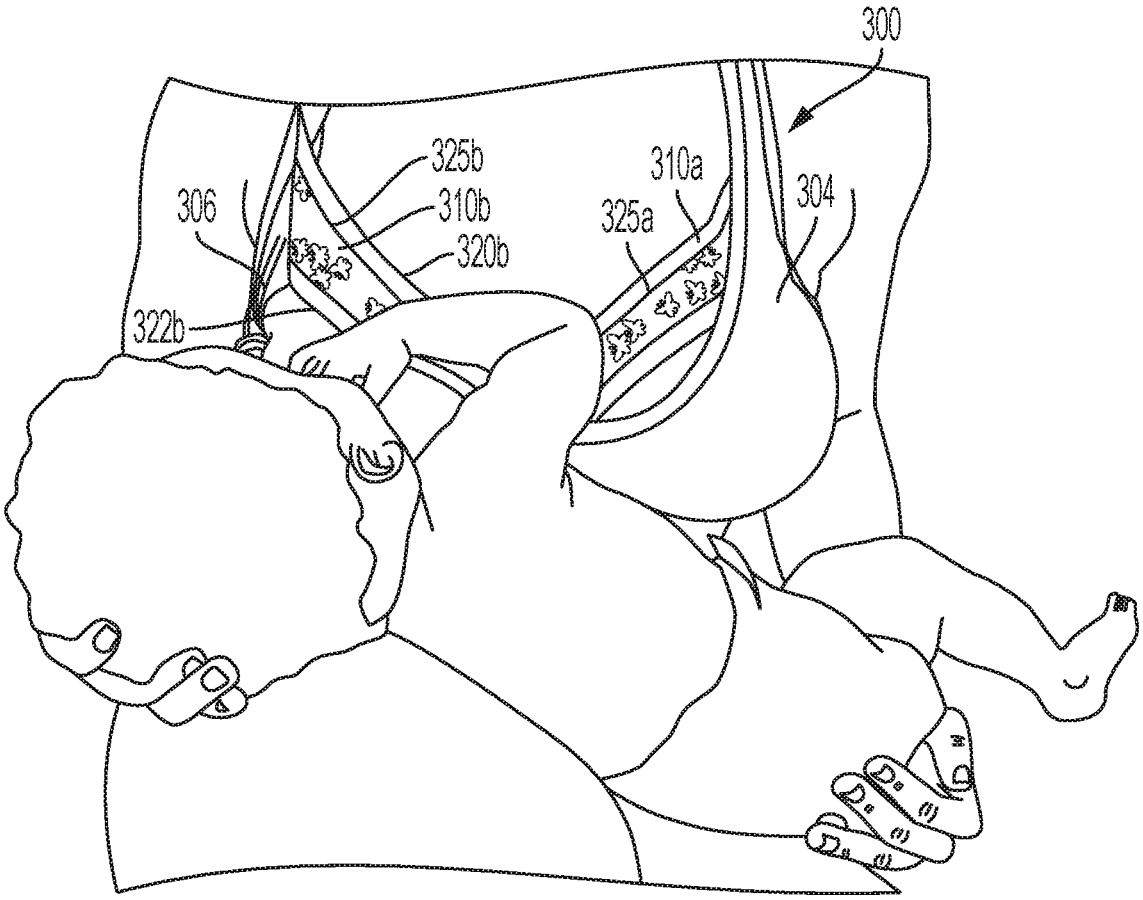
FIG. 12 is a perspective view of the embodiment of the nursing bra illustrated in FIG. 10 with the second cup portion is a feeding position.

FIGS. 10 to 12 illustrate a further embodiment of a nursing bra 300. The nursing bra 300 may include any of all of several portions known in the art. For example, the nursing bra 300 may include a bra body 302, a first cup portion 304 coupled to or at least partially integrally formed with the bra body 302, and a second cup portion 306 coupled to or at least partially integrally formed with the bra body 302. The first cup portion 304 may be on the left side of a mother wearing the nursing bra 300 and the second cup portion 306 may be on the right side of a mother wearing the nursing bra 300, or vice versa. A top portion of the first cup portion 304 may be coupled to or at least partially integrally formed with a first portion of a first strap 307, and the first strap 307 may be coupled to (or a part of) the bra body 302. The first strap 307 may be elongated and may extend over the left (or right) shoulder of the mother when wearing the nursing bra 300. A top portion of the second cup portion 306 may be coupled to or at least partially integrally formed with a first portion of a second strap 309, and the second strap 309 may be coupled to (or a part of) the bra body 302. The second strap 309 may be elongated and may extend over the left (or right) shoulder of the mother when wearing the nursing bra 300.

A bottom portion of the first cup portion 304 may be secured to a band portion 311 of the bra body 302, and the band portion 311 may be adapted to extend around a portion of the upper abdomen of the mother wearing the nursing bra 300. A bottom portion of the second cup portion 306 may be secured to the band portion 311 of the bra body 302. The band portion 311 may be made from any suitable material and have any suitable configuration. For example, the band portion 311 may be made of an elastic material (e.g., fabric). In some embodiments, the band portion 311 may have a clasp portion (not shown) that releasably secures a first end of the band portion 310 to a second end of the band portion 311 to allow the mother to secure the nursing bra 300 in a suitable position. In other embodiments, the band portion 311 does not have a clasp portion and the material may stretch to allow the mother to position the band portion 311 in a suitable position.

Referring to FIG. 10, the second portion of the first strap 307 may be coupled to or at least partially integrally formed with a first portion of a back portion 312 of the bra body 302, and a second portion of the second strap 309 may be coupled to or at least partially integrally formed with a second portion of the back portion 312. A bottom portion of the back portion 312 may be at least partially secured to the band portion 311 of the bra body 302.

As illustrated in FIGS. 10 to 13, the nursing bra 300 also includes at least one sensory insert 310 (or sensory portion) that may be secured to a portion of the bra body 302 (e.g., a portion of the first cup portion 304 and/or the second cup portion 306) such that when the first cup portion 304 (and/or the second cup portion 306) is in any position suitable for nursing (e.g., as illustrated in FIG. 12), the sensory insert 310 is visible (or at least partially visible) to the nursing child.

In the example embodiment of FIG. 11 (which illustrates a rear view of the first cup portion 304 and the second cup portion 306 of the nursing bra 300), the nursing bra 300 may include a first sensory insert 310*a* and a second sensory insert 310*b*. The first sensory insert 310*a* may be elongated and may extend from a first end 314*a* to a second end 316*a* opposite the first end 314*a* along a first insert axis 318*a*. The first insert axis 318*a* may be linear or generally linear. One having ordinary skill in the art would understand that due to the flexibility of the material (or combination of materials) making up the first sensory insert 310*a*, the first insert axis 318*a* may not be linear in all configurations. For example, when a mother is wearing the nursing bra 300 as illustrated in FIG. 12, the first insert axis 318*a* may be contoured to a corresponding portion of the chest of the mother, but may be linear in a front view of the mother.

The first end 314*a* of the first sensory insert 310*a* may be secured to any suitable portion of the bra body 302, such as a portion of the first cup portion 304 and/or a portion of the first strap 307. For example, the first end 314*a* of the first sensory insert 310*a* may be secured at or adjacent to the top portion of the first cup portion 304 and/or at or adjacent to the first portion of a first strap 307. The second end 316*a* of the first sensory insert 310*a* may be secured to any suitable portion of the bra body 302, such as a portion (e.g., a bottom portion) of the first cup portion 304 and/or a portion of the band portion 311. The first sensory insert 310*a* may also include or be defined by a first lateral edge 318*a* and a second lateral edge 320*a*, and each of the first lateral edge 320*a* and the second lateral edge 322*a* may extend or generally extend along the first insert axis 318*a* from the first end 314*a* to the second end 316*a* of the first sensory insert 310*a*. The first and second lateral edges 318*a*, 320*a* may be linear or substantially linear, or one of both of the first and second lateral edges 318*a*, 320*a* may be at least partially contoured or non-linear.

Turning to the second sensory insert 310*b*, some embodiments of the second sensory insert 310*b* may be a mirror image of, but otherwise identical to, the first sensory insert 310*a*. Specifically, the second sensory insert may be elongated and may extend from a first end 314*b* to a second end 316*b* opposite the first end 314*b* along a second insert axis 318*b*. The second insert axis 318*b* may be linear or generally linear. One having ordinary skill in the art would understand that due to the flexibility of the material (or combination of materials) making up the second sensory insert 310*b*, the second insert axis 318*b* may not be linear, as previously explained.

Referring again to FIG. 11, the first end 314*b* of the second sensory insert 310*b* may be secured to any suitable portion of the bra body 302, such as a portion of the second cup portion 306 and/or a portion of the second strap 309. For example, the first end 314*b* of the second sensory insert 310*b* may be secured at or adjacent to the top portion of the first cup portion 304 and/or at or adjacent to the first portion of a first strap 307. The second end 316*b* of the second sensory insert 310*b* may be secured to any suitable portion of the bra body 302, such as a portion (e.g., a bottom portion) of the second cup portion 306 and/or a portion of the band portion 311.

The second sensory insert 310*b* may also include or be defined by a first lateral edge 318*b* and a second lateral edge 320*b*, and each of the first lateral edge 320*b* and the second lateral edge 322*b* may extend or generally extend along the second insert axis 318*b* from the first end 314*b* to the second end 316*b* of the second sensory insert 310*b*. In some embodiments, the first lateral edge 320*b* may be positioned or configured to extend along all or a portion of an inner cup edge 324*b* of the second cup portion 306 (as illustrated in FIG. 10) when the nursing bra 300 is worn by the mother and when not feeding or preparing to feed a child. This configuration hides or conceals the second sensory insert 310*b* when the mother is not feeding the child. One having ordinary skill in the art would recognize that the first lateral edge 320*a* of the first sensory insert 310*a* may be similarly positioned or configured to extend along all or a portion of an inner cup edge 324*a* of the first cup portion 304 (illustrated in FIG. 10) when the nursing bra 300 is worn by the mother and when not feeding or preparing to feed a child.

Similar to the sensory insert 210 of the nursing bra 200, the second sensory insert 310 (e.g., the first sensory insert 310*a* and/or the second sensory insert 310*b*) may have a visible portion 325*a*, 325*b*, that may be at least partially covered by a pattern, graphic, and/or image, as illustrated in FIG. 10. The pattern, graphic, and/or image may be any pattern, graphic, and/or image (or combination of patterns, graphics, and/or images) that attracts or is capable of attracting the attention of a child during nursing. For example, the pattern, graphic, and/or image may include a high-contrast pattern, graphic, and/or image. For example, the pattern, graphic, and/or image may include black and white patterns, graphics, and/or images, such as those (or similar to those) illustrated in FIG. 9. The visible portion 325*a*, 325*b* of the first or second sensory insert 310*a*, 310*b* may cover the entire first or second sensory insert 310*a*, 310*b* or one or more portions of the first or second sensory insert 310*a*, 310*b*. In some embodiments, the visible portion 325*a*, 325*b* may also include one or more tactile areas configured to provide tactile stimulation to the child when touched by the child. For example, the tactile areas may be raised areas or may be areas made from one or more materials that are different than other portions of the visible portion 325*a*, 325*b*. In some embodiments, the visible portion 325*a* of the first sensory insert 310*a* may have one or more portions or (e.g., colors, images, and/or textures) than the visible portion 325*b* of the second sensory insert 310*b*.

In use, a nursing mother may grasp the inner cup edge 324*b* of the second cup portion 306 of the nursing bra 300 and downwardly displace the inner cup edge 324*b* to expose the nipple, as illustrated in FIG. 12. The inner cup edge 324*b* may be placed under the breast of the mother to maintain the second cup portion 306 in a suitable feeding position. In this feeding position, the second sensory insert 310*b* is configured to remain stationary relative to the mother such that at least a portion of the visible portion 325*b* of the second sensory insert 310*b* is configured to be visible (e.g., within the field of vision) of the child when latched on to the mother and feeding. When the child nurses, the pattern, graphic, and/or image attracts and maintains the attention of the child, thereby reducing restlessness in the child and making the nursing process more efficient.

While various embodiments have been described above, this disclosure is not intended to be limited thereto. Variations can be made to the disclosed embodiments that are still within the scope of the appended claims.

What is claimed is:

1. A nursing bra assembly adapted to be worn by a mother when nursing a child, the nursing bra assembly comprising:

a nursing bra comprising:

a bra body adapted to cover at least a portion of a chest of the mother, the bra body having a left cup portion and a right cup portion;

a left strap extending from a first portion of the bra body to a second portion of the bra body, the first portion being adjacent to a portion of the left cup portion; and a right strap extending from a third portion of the bra body to a fourth portion of the bra body, the third portion being adjacent to a portion of the right cup portion;

a first attachment member coupled to one of the left strap, the right strap, the left cup portion, or the right cup portion of the nursing bra, the first attachment member having a first securement portion adapted to couple the first attachment member to the one of the left strap, the right strap, the left cup portion, or the right cup portion of the nursing bra, the first attachment member having a first extension portion coupled to the first securement portion, the first extension portion adapted to be grasped by the child when being nursed by the mother, wherein the first extension portion is a loop made of a fabric material; and a second attachment member coupled to one of the left strap, the right strap, the left cup portion, or the right cup portion of the nursing bra, the second attachment member having a second securement portion adapted to couple the second attachment member to the one of the left strap, the right strap, the left cup portion, or the right cup portion of the nursing bra, the second attachment member having a second extension portion coupled to the second securement portion, the second extension portion adapted to be grasped by the child when being nursed by the mother, wherein the second extension portion is a loop made of a fabric material.

2. The nursing bra of claim 1, wherein the first securement portion of the first attachment member is removably coupled to one of the left strap or the right strap.

3. The nursing bra of claim 2, wherein the first securement portion of the first attachment member comprises a clip.

4. The nursing bra of claim 1, wherein the first attachment member is identical to the second attachment member.

5. The nursing bra of claim 1, wherein the first securement portion of the first attachment member and the second securement portion of the second attachment member are each removably coupled to the right strap, or wherein the first securement portion of the first attachment member and the second securement portion of the second attachment member are each removably coupled to the left strap.

6. The nursing bra of claim 1, wherein the first securement portion of the first attachment member and the second securement portion of the second attachment member are offset along an axis that extends along one of the left strap or the right strap.

7. The nursing bra of claim 6, wherein the first extension portion of the first attachment member and the second extension portion of the second attachment member each extends along an axis that is normal to the axis that extends along one of the left strap or the right strap.

8. The nursing bra of claim 1, wherein the first extension portion of the first attachment member is elongated and extends away from the first securement portion of the first attachment member.

9. The nursing bra of claim 8, wherein the first securement portion of the first attachment member is coupled to one of the left strap or the right strap, and wherein the first extension portion of the first attachment member extends along an axis that is normal to an axis extending along the left strap or the right strap.

10. The nursing bra of claim 1, wherein the first portion of the bra body is a first left side portion of the bra body and the second portion of the bra body is a second left side portion of the bra body, and wherein the third portion of the bra body is a first right side portion of the bra body and the fourth portion of the bra body is a second right side portion of the bra body.

11. The nursing bra of claim 1, wherein the first extension portion of the first attachment member includes a high-contrast image.

12. The nursing bra of claim 1, wherein at least one attachment is coupled to the first extension portion of the first attachment member.

13. A nursing bra assembly adapted to be worn by a mother when nursing a child, the nursing bra assembly comprising:

a nursing bra comprising:

a bra body adapted to cover at least a portion of a chest of the mother, the bra body having a left cup portion and a right cup portion;

a left strap extending from a first portion of the bra body to a second portion of the bra body, the first portion being adjacent to a portion of the left cup portion; and a right strap extending from a third portion of the bra body to a fourth portion of the bra body, the third portion being adjacent to a portion of the right cup portion; and an attachment member coupled to one of the left strap, the right strap, the left cup portion, or the right cup portion of the nursing bra, the attachment member having a securement portion adapted to couple the attachment member to the one of the left strap, the right strap, the left cup portion, or the right cup portion of the nursing bra, the attachment member having an extension portion coupled to the securement portion, the extension portion adapted to be grasped by the child when being nursed by the mother, wherein the extension portion is a loop made of a fabric material.

14. The nursing bra of claim 13, wherein the securement portion of the attachment member comprises a clip.

15. The nursing bra of claim 13, wherein the extension portion of the attachment member includes a high-contrast image.

16. The nursing bra of claim 13, wherein at least one attachment is coupled to the extension portion of the attachment member.

17. The nursing bra of claim 13, wherein the extension portion of the attachment member is removably coupled to the securement portion of the attachment member.

18. The nursing bra of claim 13, wherein the extension portion of the attachment member has a first portion having a first texture and a second portion having a second texture.

19. The nursing bra of claim 13, wherein the securement portion of the attachment member is removably coupled to the one of the left strap, the right strap, the left cup portion, or the right cup portion of the nursing bra.

20. The nursing bra of claim 13, wherein the securement portion of the attachment member is coupled to one of the left strap or the right strap, and wherein the extension portion extends along an axis that is normal to an axis extending along the left strap or the right strap.

* * * * *